US007140526B2

(12) United States Patent
Matsukawa

(10) Patent No.: US 7,140,526 B2
(45) Date of Patent: Nov. 28, 2006

(54) STAPLER

(75) Inventor: Takeshi Matsukawa, Tokyo (JP)

(73) Assignee: Plus Stationary Corporation, Tokyo (JP)

( * ) Notice: Subject to any disclaimer, the term of this patent is extended or adjusted under 35 U.S.C. 154(b) by 0 days.

(21) Appl. No.: 11/023,270

(22) Filed: Dec. 27, 2004

(65) Prior Publication Data

US 2006/0138192 A1 Jun. 29, 2006

(51) Int. Cl.
*B25C 5/10* (2006.01)

(52) U.S. Cl. ..... 227/132; 227/120; 227/129

(58) Field of Classification Search ..... 227/120, 227/129, 132

See application file for complete search history.

(56) References Cited

U.S. PATENT DOCUMENTS 1,962,874 A * 6/1934 Fridolin ..... 227/123
1,998,328 A * 4/1935 McKinnie ..... 227/129
3,758,016 A * 9/1973 Olney et al. ..... 227/132
5,335,839 A * 8/1994 Fealey ..... 227/132
5,492,261 A * 2/1996 Chi ..... 227/128
5,639,007 A * 6/1997 Nakamura ..... 227/109
5,758,813 A * 6/1998 Kikuchi et al. ..... 227/155
5,890,642 A * 4/1999 Sato ..... 227/134
5,979,736 A * 11/1999 Edeholt ..... 227/132
6,179,193 B1 * 1/2001 Nagai ..... 227/123
6,776,321 B1 * 8/2004 Jairam et al. ..... 227/134
6,918,525 B1 * 7/2005 Marks ..... 227/120
6,966,479 B1 * 11/2005 Tanaka et al. ..... 227/144

FOREIGN PATENT DOCUMENTS

JP 2002-028877 1/2002

* cited by examiner

*Primary Examiner*—Scott A. Smith
*Assistant Examiner*—Gloria R. Weeks
(74) *Attorney, Agent, or Firm*—Rodman & Rodman

(57) ABSTRACT

A stapling operation can be performed with a comparatively small force. The stapler includes a base frame with a support element, and an operation frame pivotally attached to the support element through a main shaft. A staple pressure lower plate is disposed at the operation frame and drives staples stored in a staple magazine upon rotation of the operation frame. The stapler further includes a handle frame at an upper part of the operation frame pivotally attached to the support element such that a rear end part of the operation frame is located above the main shaft. An intermediate element is pivotally attached at one end to the handle frame. The other end of the intermediate element is pivotally attached to the operation frame.

1 Claim, 7 Drawing Sheets

STAPLER

BACKGROUND OF THE INVENTION

1. Field of the Invention

This invention relates to a stapler, in which the stapling operation can be performed by driving a staple through sheets of paper, etc., with a comparatively small force.

2. Related Art

Staplers are known without the need of listing a specific example. A typical stapler includes three members, i.e., an operation frame, a staple magazine and a base frame which are all pivotally attached together at their rear ends. In operation, the staples stored in the staple magazine are pressed against a staple receiving board, which is disposed at the front end of the base frame and driven, one by one, into sheets of paper by means of a staple pressure lower piece, which is disposed at the front end of the operation frame. In order to facilitate this stapling operation in a stapler of the known construction through the operation frame, a handle frame is disposed at the outer side of the operation frame. This handle frame is provided at an intermediate part of its rear end in the back and forth direction of the handle frame with a pin. This pin is brought into engagement with a slot which is formed in an intermediate part of the operation frame so that the handle frame is linked to the operation frame. At the time of stapling operation achieved by pressing the front end of the handle frame, the control frame is pivotally rotated under the effect of lever action serving the pin part as a point of action. Owing to this construction, the pressing force to the front end side of the handle frame is exhibited greatly on the operation frame side and therefore, the driving operation (stapling operation) of the staple can be performed with a comparatively small force (for example, see Japanese Patent Application Laid-Open No. 2002-28877).

However, the above-mentioned conventional techniques have the following problems. Since the operation frame is pivotally rotated by moving the pin, which is disposed at the handle frame side, through the slot, which is formed at the operation frame side, the pin and the edge part of the slot are mutually pressed against each other and deformed. This deformation causes the pressing force applied to the staple to be reduced, thus resulting in deterioration of the original function which the stapler inherently has.

The present invention has been accomplished in view of the above problems.

SUMMARY OF THE INVENTION

It is, therefore, an object of the present invention to provide a unique stapler which is capable of obviating the above-mentioned problems and in which stapling operation can be performed by driving a staple through sheets of paper, etc., with a comparatively small force.

To achieve the above object, according to the present invention, there is provided a stapler comprising a base frame, a support element erected from a rear end of the base frame, an operation frame pivotally attached at a rear end part thereof directly or indirectly to the support element through a main shaft, a staple pressure lower plate disposed at the operation frame, and the staple pressure lower plate being lowered to drive staples stored in a staple magazine, one by one, between the operation frame and the base frame in accordance with rotation of the operation frame so that sheets of paper sandwichingly retained between the base frame and a staple receiving board are stapled, the stapler further comprising a handle frame disposed at an upper part of the operation frame and pivotally attached at a rear end part thereof to the support element such that the rear end part is located at an upper part of the main shaft, and an intermediate element one end of which is pivotally attached to an intermediate part in the back and forth direction of the handle frame and the other end of which is pivotally attached to the operation frame.

The above and other objects, characteristic features and advantages of the present invention will become more apparent to those skilled in the art by the following description of the preferred embodiment of the invention, as illustrated in the accompanying drawings.

DETAILED DESCRIPTION OF THE PREFERRED EMBODIMENTS

Figure 1:
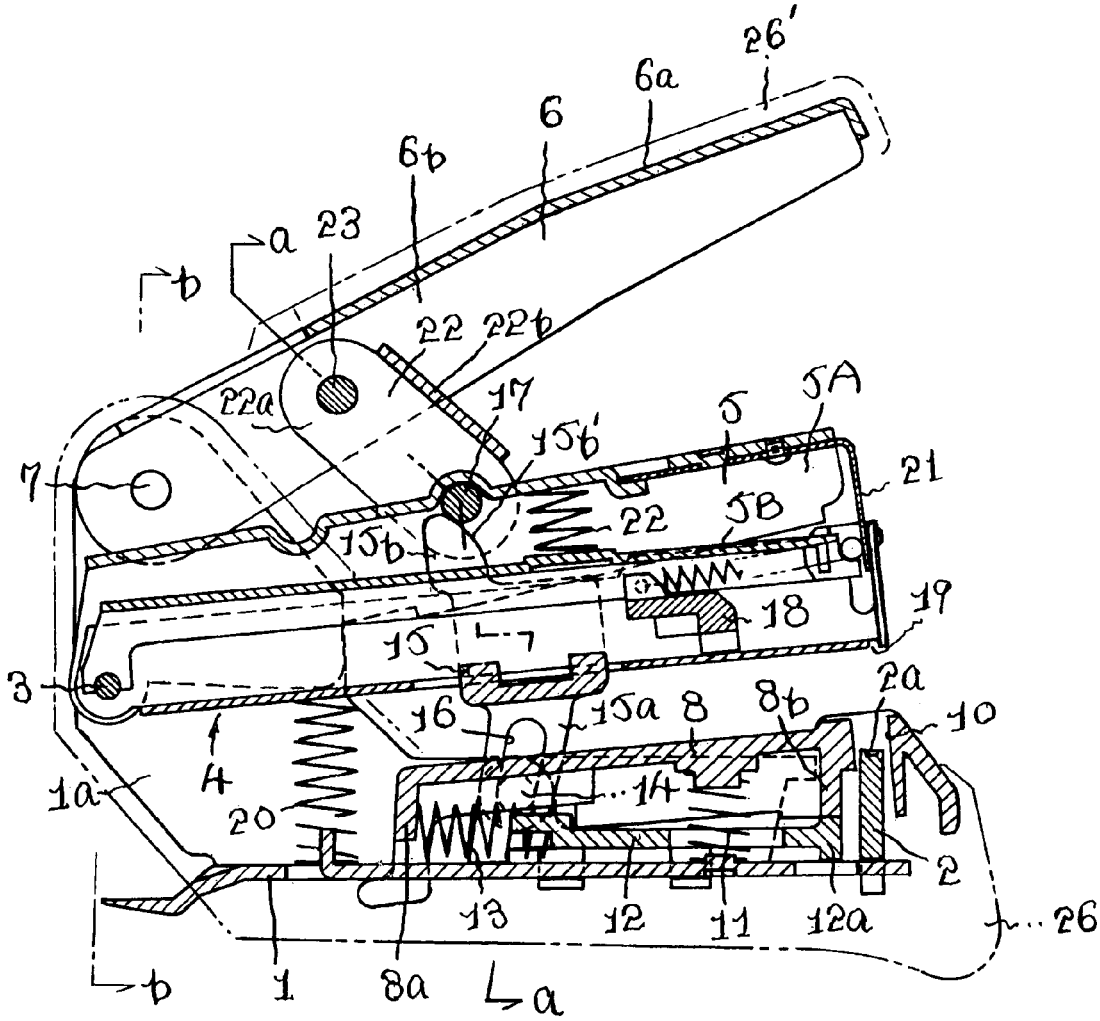
FIG. 1 is a vertical sectional view of a stapler according to one preferred embodiment of the present invention.
Figure 2:
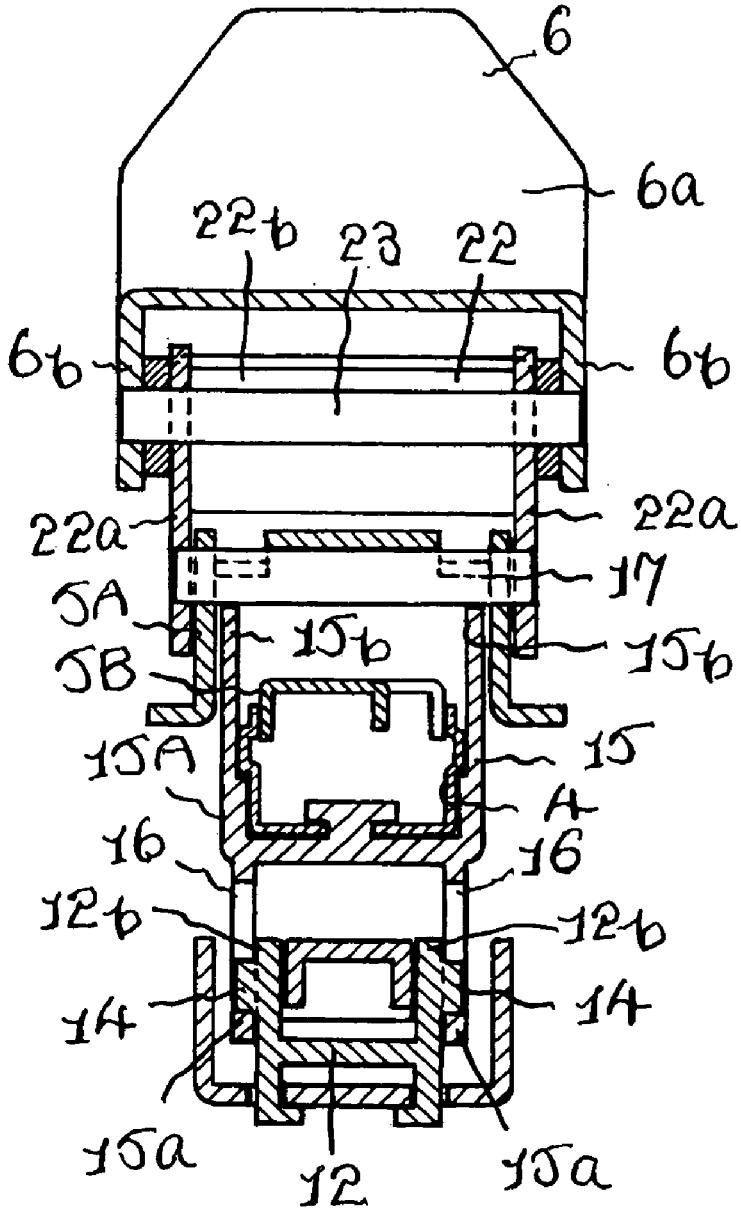
FIG. 2 is a sectional view taken on line a—a of FIG. 1.
Figure 3:
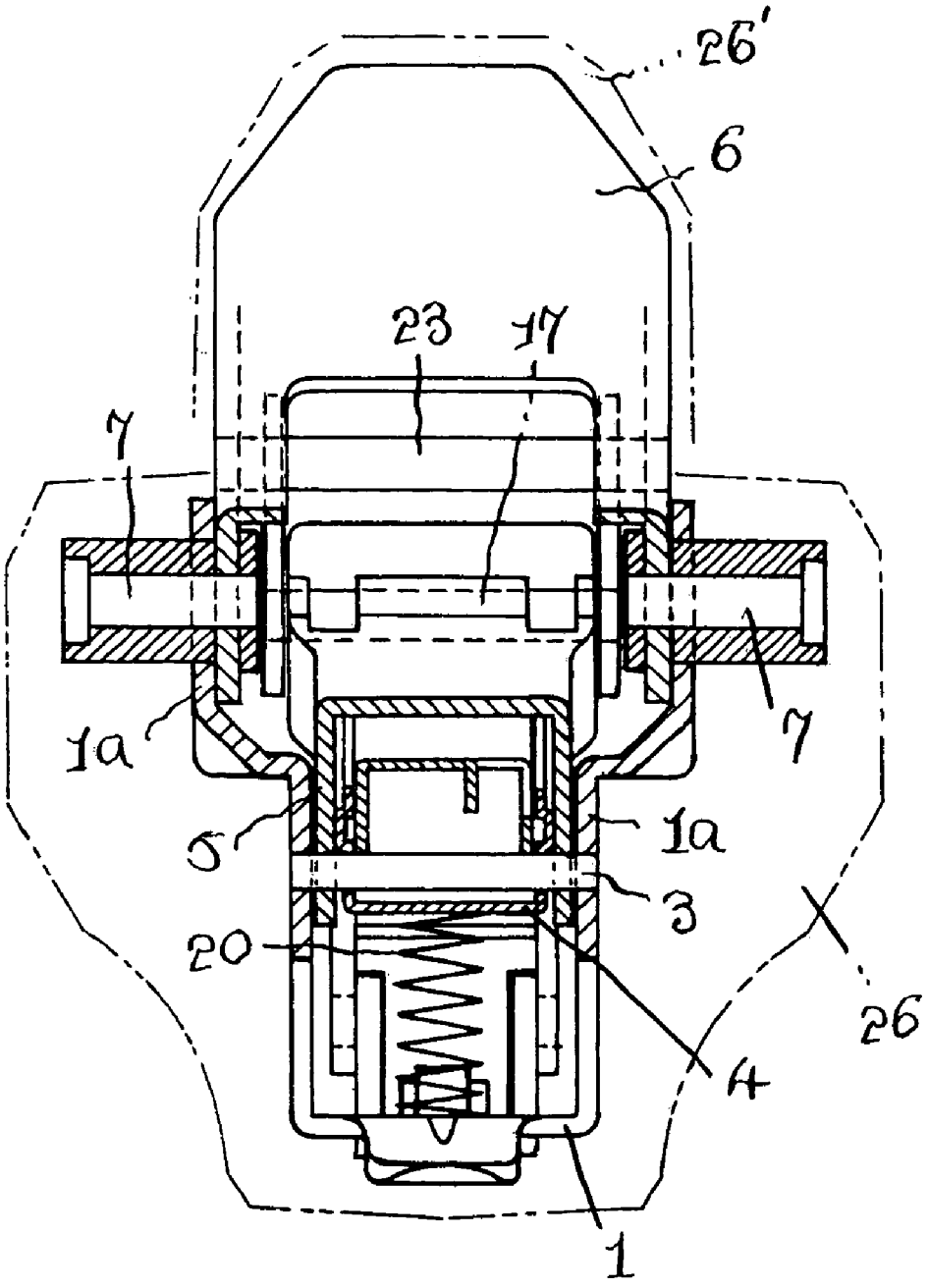
FIG. 3 is a sectional view taken on line b—b of FIG. 1.
Figure 4:
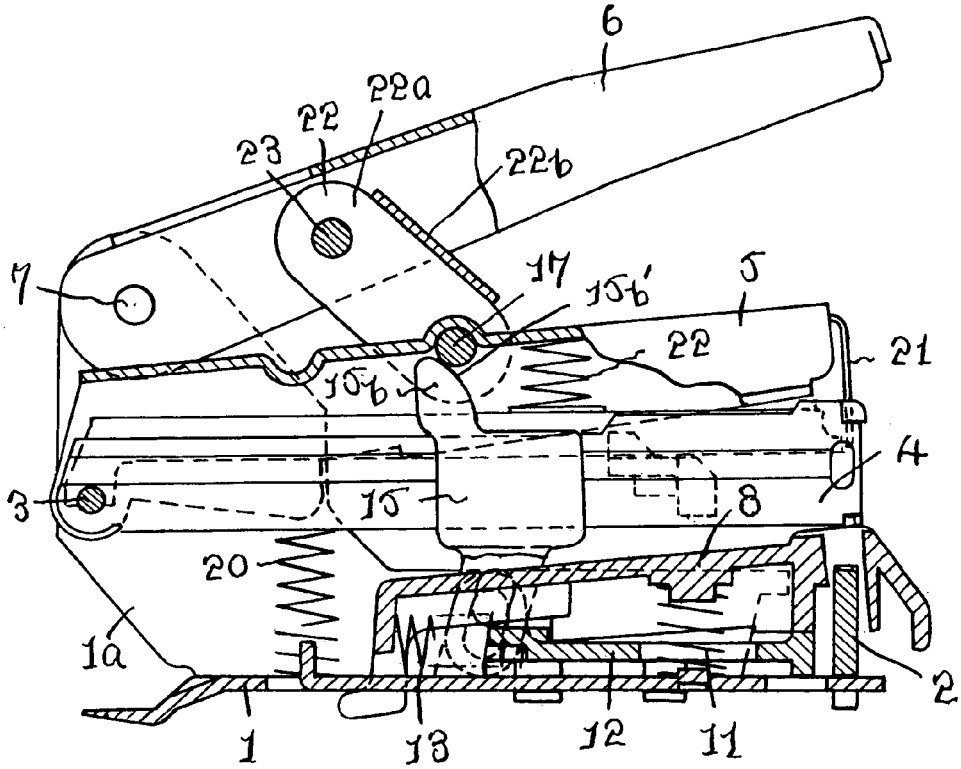
FIG. 4 is a vertical sectional view showing the above stapler which is in the process of stapling operation.
Figure 5:
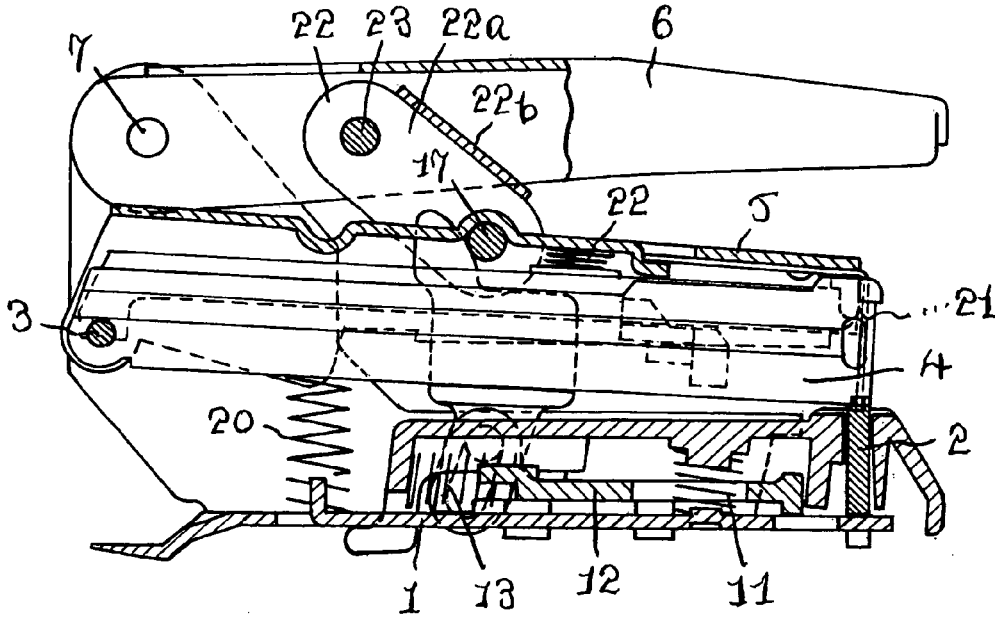
FIG. 5 is a vertical sectional view showing the above stapler at the time of completion of the stapling operation.

Preferred embodiments of the present invention will now be described in detail with reference to the accompanying drawings.

In a first preferred embodiment of FIGS. 1 through 6, reference numeral 1 denotes a base frame which is provided at a front end thereof with a staple receiving board 2 and at a rear end. A pair of support elements 1*a* are erected from a rear end of the base frame 1 in such a manner as to oppose to each other. A staple magazine 4 and an operation frame 5 are pivotally attached at rear ends thereof to the support elements 1*a* through a main shaft 3, and a handle frame 6 is pivotally attached at a rear end thereof to the support elements 1*a* through support shafts 7 which are disposed at an upper part of the main shaft 3.

A paper receiving frame 8, which has an element 8*a* disposed at a rear end thereof and assembled to the base frame 1, is assembled to the rear end of the base frame 1 such that a front end of the paper receiving frame 8 is elevated about the element 8*a* as its fulcrum. A vertical hole 10 is formed at a front end of the paper receiving frame 8. The staple receiving board 2, which is disposed at the base frame 1 and provided at an upper surface thereof with a staple guide groove 2*a*, is engaged with the vertical hole 10. A first spring 11 is disposed at the front side, which is on the side of the staple receiving board 2, of the paper receiving frame 8, so that the front ends of the base frame 1 and the paper receiving frame 8 are biased in a mutually separating and opening direction, i.e., in a direction toward which the front end of the paper receiving frame 8 is moved upward. Owing to this arrangement, as shown in FIG. 1, when no pressing action is acted on the paper receiving frame 8 by the staple magazine 4, the guide groove 2*a* part of the staple receiving board 2 is located at an intermediate position of the vertical groove 10.

Reference numeral 12 denotes a regulation frame which is engaged with and assembled to the base frame 1 at a lower side of the paper receiving frame 8. The regulation frame 12 is biased by a second spring 13, which is interposed between the rear end of the regulation frame 12 and the element 8*a* on the rear end side of the paper receiving frame 8, so that the frame element 12*a* on the front end side is located immediately under a front end element 8*b* of the paper receiving frame 8 so as to bear and regulate the downward movement of the front end element 8*b*.

The regulation frame 12 includes a pair of erection elements 12*b* which are opposed to each other through the rear end of the paper receiving frame 8. A projection element 14 disposed at the erection element 12*b* is engaged with a slanted slot 16 which is formed at a leg element 15*a* of a linkage member 15. The projection element 14 is pressed by the edge part of the slanted slot 16 at the time of downward movement of the regulation frame 12 along the projection element 14 engaged with the slanted slot 16, and the regulation frame 12 is moved backward against the biasing force of the second spring 13. As a result, the frame element 12*a* of the regulation frame 12 is escaped from the front end element 8*b* of the paper receiving frame 8.

The linkage member 15 is fixed to the staple magazine 4 with its generally groove-like main frame 15A holding an intermediate part of the staple magazine 4. The leg element 15*a* is projected from the underside of the main frame 15A, and the projection element 14 is engaged with the slanted slot 16 so that the main frame 15A is linked to the regulation frame 12. The main frame 15A is provided at a rear end of its upper side with a pressure receiving element 15*b* projecting from the upper edge of the staple magazine 4. The pressure receiving element 15*b* includes an arcuate front edge 15*b*'. A presser rod 17, which is disposed at an intermediate part of the operation frame 5, is moved downward along the front edge 15*b*'. At that time, the presser rod 17 presses the front edge 15*b*'. As a result, the linkage member 15 provided with the pressure receiving element 15*b* is moved downward. Then, due to engagement between the projection element 14 and the slanted slot 16, the regulation frame 12 is moved backward against the biasing force of the second spring 13 in the manner as previously mentioned.

The staple magazine 4 is of the known construction (but of course, different from the present one in the respect that the linkage member 15 is assembled to the intermediate part) in which the staple is fed into an outlet port 19 formed at its front end by a press feeding element 18 which is slidingly fitted thereto, and a gap formed between the staple magazine 4 and the base frame 1 is retained by a return spring 20 which is interposed between the rear part of the staple magazine 4 and the rear part of the base frame 1. The operation frame 5 is of the known construction comprising a main frame 5A provided at its front end with a staple pressure lower plate 21 and an auxiliary frame 5B disposed at the inner side of the main frame 5A, a second return spring 22 having a stronger spring property than the return spring 20 being interposed between the main frame 5A and the auxiliary frame 5B. The presser rod 17 for press contacted with the front end edge 15*b*' of the pressure receiving element 15*b* of the linkage member 15 disposed at the staple magazine 4 side is mounted on the intermediate part of the main frame 5A, and one end of the intermediate element 22 is pivotally assembled by serving this presser rod 17 as a pivot.

The intermediate element 22 is formed by connecting side elements 22*a* to the center element 22*b* in such a manner as oppose to each other. One ends of the side elements 22*a* is pivotally attached to the operation frame 5 through the presser rod 17 in the manner as previously mentioned with the intermediate part of the operation frame 5 (main frame 5A) interposed between the side elements 22*a*, and the other ends of the side elements 22*a* is disposed backward and upward (at the time of use as a stapler) of the presser rod 17, and the rear ends (basal ends) are interposed between the side elements 6*b* of the handle frame 6, which is pivotally attached to an upper part of the support element 1*a* of the base frame 1 through the support shaft 7.

The handle frame 6 comprises a center element 6*a* and a pair of side elements 6*b* which are opposed to each other in the longitudinal direction (back and forth direction) with the center element 6*a* disposed therebetween. Rear ends (basal ends) of the side elements 6*b* are pivotally attached to the corresponding support elements 1*a* of the base frame 1 through support shafts 7 which are coaxially arranged and carried on an intermediate element 22 which is interposed between the intermediate part and the operation frame 5 with their intermediate parts slanted backward and upward. The front ends of the side elements 6*b* are located in such a manner as to be separated from the operation frame 5.

When the front end of the handle frame 6 is pressed downward in the direction of the base frame 1 about the support shafts 7, the handle frame 6 presses downward the presser rod 17 through the pivot 23 and the intermediate element 22. Since the presser rod 17 is attached to the main frame 5A of the operation frame 5, the main frame 5A tends to turningly move downward about the main shaft 3. However, the first spring 11 is smaller in spring property than the second return spring 13, the operation frame 6 including the main frame 5A and the staple magazine 4 are turningly moved downward about the main shaft before the main frame 5A is moved downward alone Simultaneous with this turning downward movement, the linkage member 15 disposed at the staple magazine 4 is also moved downward and the slanted slot 16 part formed at the leg element 15*a* of the linkage member 15 is also moved downward. The slanted slot 16 part presses the projection element 14 with a predesigned angle of inclination. The regulation frame 12 provided with the projection element 14 is moved backward against the biasing force of the second spring 13, and a clearance is formed immediately under the front end element 8*b* of the paper receiving frame 8. In that condition, the front end side of the staple magazine 4 pressed down by the presser rod 17 presses down the paper receiving frame 8, and the front end side of the paper receiving frame 8 is moved downward against the biasing force of the first spring 11, so that the guide groove 2*a* part of the staple receiving board 2 disposed at the base frame 1 is relatively projected to the upper end position of the vertical hole 10 of the paper receiving frame 8. By means of the continuous turning operation of the handle frame 6 about the support shaft 7, the turning downward movement of the staple magazine 4 which is press contacted with the paper receiving frame 8 is regulated, and at the same time, the operation frame 5 continues to turn about the main shaft 3 and move downward against the biasing force of the second return spring 20. As a result, the staple pressure lower plate 21 drives out the staple stored in the staple magazine 4 through the outlet port 19, and presses the staple penetrated through the sheets of paper sandwichingly held between the paper receiving frame 8 and the staple magazine 4 against the staple receiving board 2, so that the staple is folded in a horizontal posture. By doing so, the stapling operation of the sheets of paper is conducted. In a series of this operation, by pressing down the front end side of the handle frame 6 in the direction of the base frame 1 where the staple magazine 4, etc. are interposed, the handle frame 6 is turned about the support shaft 7 on the rear end (basal end) side as a fulcrum. This pressing down (turning) operation is exhibited at the pivot 23 part as a point of action. By this so-called principle of a lever, a small pressing force given to the handle frame 6 is exhibited as a large press-down force applicable to the operation frame 5, etc. This makes it possible to perform the stapling operation easily.

Figure 6:
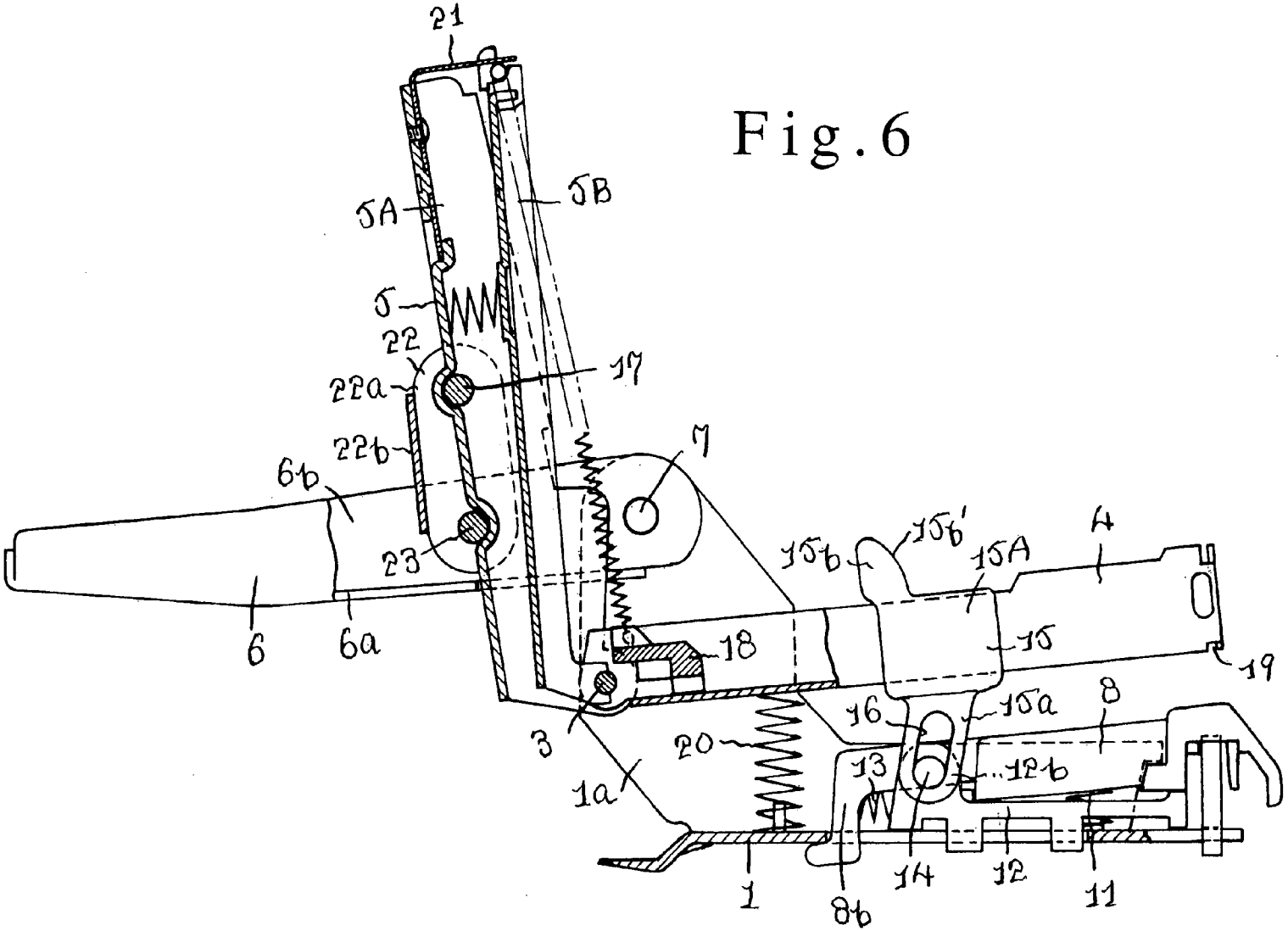
FIG. 6 is a vertical sectional view of the above stapler at the time of loading operation of staples.

FIG. 6 shows a state in which staples are loaded in the staple magazine 4. In that state, the pivot 23 of the handle frame 6 is engaged with the concave groove 24 formed at the upper surface of the operation frame 5 so that the turning of the handle frame 6 about the support shaft 7 is regulated.

In the illustration, reference numeral 26 denotes a resin cover of the base frame 1, and 26' denotes a resin cover of the handle frame 6.

Figure 7:
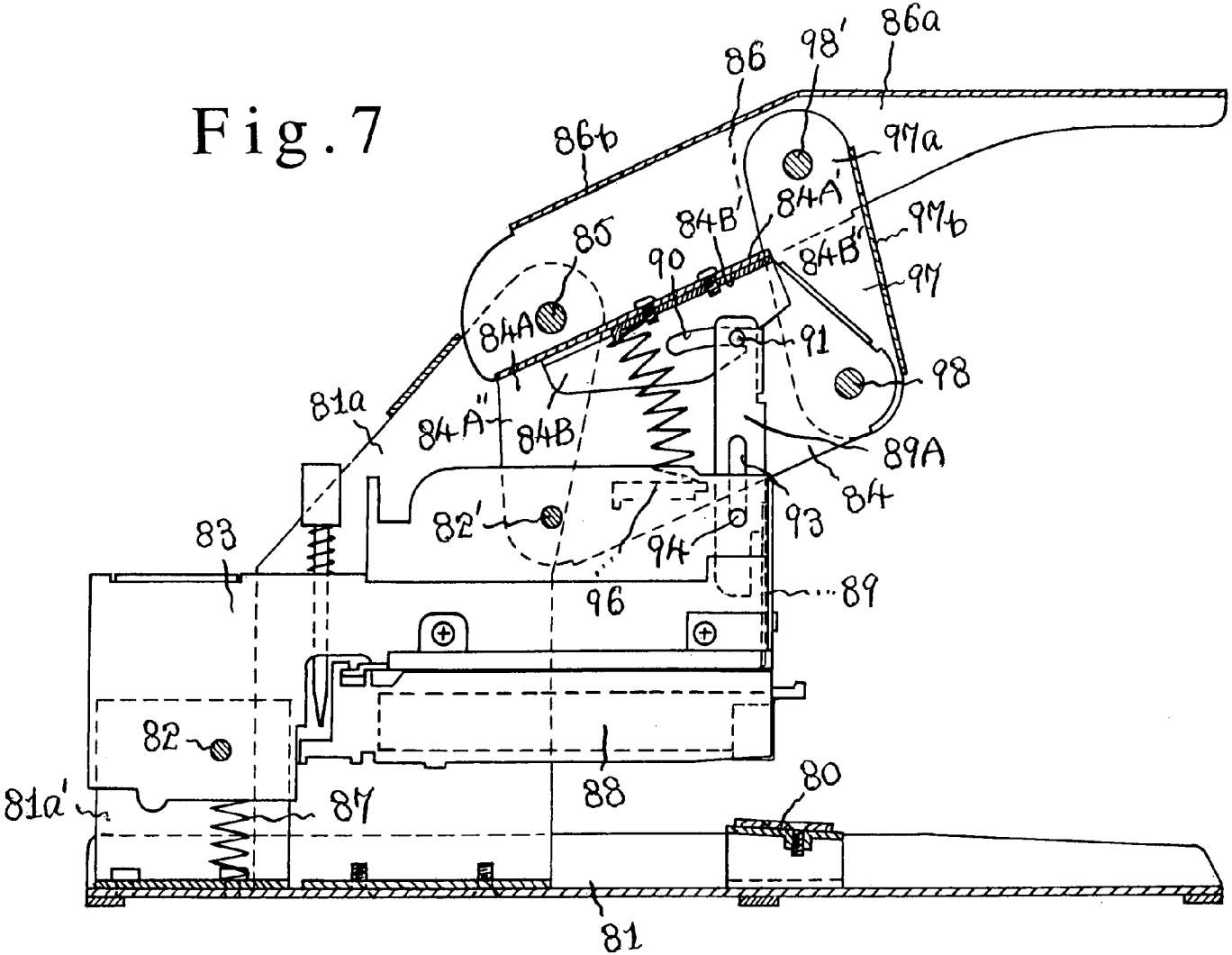
FIG. 7 is a vertical sectional view of a stapler according to a second preferred embodiment of the present invention.
Figure 8:
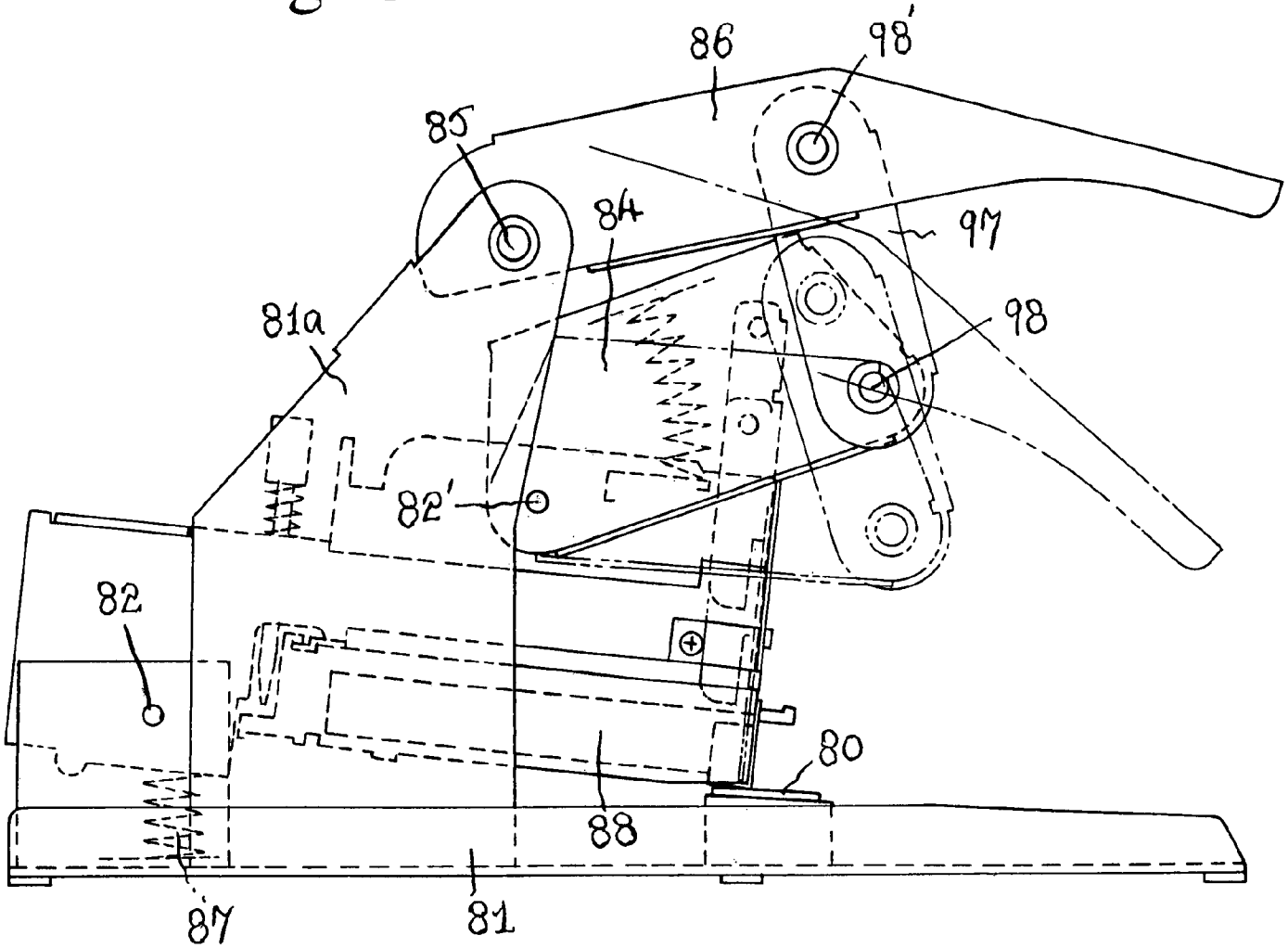
FIG. 8 is a vertical sectional view of the stapler according to the second preferred embodiment of the present invention at the time of completion of the stapling operation.

In the first preferred embodiment shown in FIGS. 1 through 6, the present invention is applied to a portable stapler. In the second preferred embodiment shown in FIGS. 7 and 8, the present invention is applied to a desktop stapler. In this second preferred embodiment, a pair of large and small support elements 81*a*, 81*a*' are erected in opposing relation at the rear end side of a base frame 81 which is provided with a staple receiving board 80. A support frame 83 is pivotally attached at a rear end thereof to the rear side small support element 81*a*' through a first main shaft 82, and an operation frame 84 is pivotally attached at a rear end thereof to an intermediate upper location of the support frame 83 through a second main shaft 82'. The handle frame 86 is pivotally attached at a rear end thereof to the upper end part of the large support element 81*a* through a support shaft 85 which is located at an upper part of the first and second main shafts 82, 82'.

As shown, the support element 81*a* is disposed at an intermediate position in the back and forth direction of the base frame 81, and the support shaft 85 to which the handle frame 86 is assembled is disposed at a location offset to the center in the back and forth direction of the base frame 81, so that the pressing load generated at the time of turning operation of the handle frame 86 about the support frame 85 is received by the center side of the base frame 81. By doing so, the movement of the base frame 81 is regulated so that the turning operation can be performed without interference.

The support frame 83 is retained in its horizontal posture by a first return spring 87 which is interposed between the support frame 83 and the base frame 81 at the rear end of the support frame 83, and a staple magazine 88 is assembled to its undersurface side such that the staple magazine 88 can be withdrawn forwardly of the support frame 83 at the time of loading the staples. A staple pressure lower plate 89, which is brought into and out of a staple outlet port (not shown) of the staple magazine 88, is disposed immediately above the staple outlet port.

The staple pressure lower plate 89 is fixedly attached to a pressure lower plate holder 89A which is supported by movably (relatively) fitting a pin 91 in an arcuate cutout 90 formed at the operation frame 84. The pressure lower plate holder 89A allows a guide pin 94, which is supported on an upper end on the front end side of the support frame 83, to penetratingly engaged with a vertical long slot 93 formed at an intermediate part thereof, so that the pressure lower plate holder 89A can vertically move at a predetermined position. When the operation frame 84 is turned about the second support shaft 82' as a fulcrum against a second return spring 95 (having a larger resilient force than the first return spring 87) which is interposed between the support frame 83 and the operation frame 84, the edge part of the arcuate cutout 90 presses down the pin 91 while moving along the pin 91. As a result, the holder 89A is moved downward and at the same time, the staple pressure lower plate 89 is moved downward to drive out the staple stored in the staple magazine 88.

The operation frame 84 is formed by arranging an auxiliary frame 84B which comprises side elements 84B" connected in such a manner as to oppose the center elements 84B' at the inner side of a main frame 84A which comprises side elements 84A" connected in such a manner as to oppose to the center elements 84A' and fixedly attaching the center elements A', 84B' to each other. The side elements 84" of the auxiliary frame 84B are provided with the arcuate cutout 90 and linked to the pressure lower plate holder 89A or the staple pressure lower plate 89 through the pin 91, and the other end of the second return spring 95 whose one end is locked to the pressure receiving element 96 disposed at the operation frame 84 is lockingly attached to the center element 84B' part.

In such a manner as to interposing the intermediate part of the upper part of the support frame 83 between one ends of the side elements 84A" of the operation frame main frame 84A, the one end pivotally attached to the support frame 83 through the second support shaft 82' in a manner as previously mentioned, One end an intermediate element 97 is pivotally attached to the other end part which corresponds to the one end as a pivot part through a connection shaft 98.

The intermediate element 97 is formed, as in the case with the intermediate element 22 of the first preferred embodiment, by connecting the side elements 97*a*, 97*a* to the center element 97*b* in such a manner as to oppose to each other. One ends of the side elements 97*a* are pivotally attached, in a manner as previously mentioned, to the operation frame 84 through the connection shaft 98 with the front end part of the operation frame 84 interposed between the side elements 97*a*, and the other ends of the side elements 97*a* are pivotally attached to an intermediate part between the side elements 86*a* of the handle frame 86 through the connection shaft 98'.

The handle frame 86 comprises the side elements 86*a* and the center element 86*b* to which the side elements 86*a* are opposed along the longitudinal direction (back and forth direction), and the rear end part i (basal end part) is pivotally attached to the upper end parts of the support elements 81*a* through the support shaft 85 in the manner as previously mentioned.

When the front end side of the handle frame 86 is pressed down in the direction of the basal frame 81 about the support shaft 85, the handle frame 86 presses the second return spring 95 so that the operation frame 84 is turningly moved downward about the second main shaft 82' through the intermediate element 97. Since the first return spring 87 is smaller in spring property than the second return spring 95, the support frame 83 to which the staple magazine 88 is assembled is turned about the first main shaft 82 as a fulcrum under the pressure of the second return spring 95, and the front end on the outlet port side of the staple magazine 88 is moved downward to overlap with the staple receiving board 80 so that the sheets of paper as an object to be stapled are sandwichingly held therebetween. Then, by continuous press-down operation of the handle frame 86, the second return spring 95 is contracted and the operation frame 84 pressed against the intermediate element 97 is turned about the second main shaft 82' as a fulcrum. In accordance with the turning operation of the operation frame 84, the edge part of the cutout 90 formed at the operation element 84 presses down the pin 91, and the holder 89A provided with the pin 91 is moved downward. Then, the staple pressure lower plate 89 attached to the holder 89A is moved downward to drive out the staple stored in the staple magazine 88 so that the sheets of paper sandwichingly held between the front end of the staple magazine 88 and the staple receiving board 80 are stapled. In a series of this operation, by pressing down the front end side of the handle frame 86 in the direction of the base frame 81 where the staple magazine 88, etc. are interposed, the handle frame 86 is turned about the support shaft 85 on the rear end (basal end) side as a fulcrum. This pressing down (turning) operation is exhibited at the pivot part as a point of action between the front end side and the support shaft 85. By this so-called principle of a lever, a small pressing force given to the handle frame 86 is exhibited as a large press-down force applicable to the operation frame 84, etc. This makes it possible to perform the stapling operation more easily compared with a stapler which is provided with the operation frame having no handle frame 86.

Since the present invention is constructed in the manner as hereinbefore described, the pressing force given to the handle frame is exhibited to the stapling operation as a large force. Thus, the stapling operation can be performed comparatively easily.

Moreover, since the pressing operation with respect to the handle frame is exhibited to the staple pressure lower plate through the linkage mechanism, a highly durable product can be provided without a need of undue force applied to the component members.

Although this invention has been described in its preferred form with a certain degree of particularity, it is understood that the present disclosure of the preferred form has been made only by way of example and that numerous changes in the details of construction and arrangement of parts may be resorted to without departing from the spirit and the scope of the invention as hereinafter claimed.

What is claimed is:

1. A stapler comprising a base frame having a paper receiving front end portion with a staple receiving board, and a non-paper receiving rear end portion, a support element erected from the non-paper receiving rear end portion of said base frame, an operation frame having a front part extending toward the front end portion of the base frame and a rear part extending toward the non-paper receiving rear end portion of the base frame, said operation frame further including an upper part extending upwardly away from said base frame, said operation frame being pivotally attached at the rear part directly or indirectly to said support element through a main shaft, a staple magazine movable with the operation frame, a staple pressure lower plate disposed at the front part of said operation frame for upward and downward movement relative to said staple magazine, and said staple pressure lower plate being raisable and lowerable in said staple magazine to drive staples stored in the staple magazine, one by one, between said operation frame and said base frame in accordance with rotation of said operation frame about said main shaft so that sheets of paper disposed between said staple magazine and the staple receiving board are stapled on the staple receiving board, said stapler further comprising a handle frame disposed at the upper part of said operation frame, the handle frame having a front end part extending away from the rear end portion of said base frame, and a rear end part extending toward the rear end portion of said base frame and being pivotally attached to said support element such that said rear end part is located above said main shaft, and an intermediate element having opposite ends, one end being pivotally fastened to said handle frame between the front end part and the rear end part of the handle frame, and offset from the main shaft, and the opposite end of the intermediate element being pivotally fastened to said operation frame in offset relationship from one end of the intermediate element and the mainshaft such that a downward force on the handle frame is transmitted through the intermediate element to the operation frame.

* * * * *